US005803055A

United States Patent [19]

Goto et al.

[11] Patent Number: 5,803,055

[45] Date of Patent: Sep. 8, 1998

[54] DEVICE FOR DETECTING REPLENISHMENT OF FUEL TANK OF AN ENGINE AND DIAGNOSTIC DEVICE FOR EVAPORATED FUEL PROCESSING MECHANISM OF THE ENGINE

[75] Inventors: Kenichi Goto, Zama; Atsushi Iochi, Tokyo, both of Japan

[73] Assignee: Nissan Motor Co., Ltd., Kanagawa, Japan

[21] Appl. No.: 749,192

[22] Filed: Nov. 14, 1996

[30] Foreign Application Priority Data

Nov. 14, 1995 [JP] Japan ..... 7-295632

[51] Int. Cl.[6] ..... F02M 25/08; F02B 77/08

[52] U.S. Cl. ..... 123/520; 123/519

[58] Field of Search ..... 123/516, 518, 123/519, 520, 494; 374/54; 141/128, 392, 59; 73/117.3, 117.4

[56] References Cited

U.S. PATENT DOCUMENTS

| | | | |
|---|---|---|---|
| 5,398,662 | 3/1995 | Igarashi et al. | 123/520 |
| 5,429,096 | 7/1995 | Fukasawa et al. | 123/514 |
| 5,460,136 | 10/1995 | Yamazaki et al. | 123/519 |
| 5,487,369 | 1/1996 | Hara et al. | 123/520 |
| 5,542,397 | 8/1996 | Takahata et al. | 123/520 |
| 5,611,623 | 3/1997 | Lawson | 374/170 |
| 5,613,778 | 3/1997 | Lawson | 374/170 |

FOREIGN PATENT DOCUMENTS

| | | |
|---|---|---|
| 2-130256 | 5/1990 | Japan . |
| 5-10215 | 1/1993 | Japan . |
| 6-81727 | 3/1994 | Japan . |
| 6-235354 | 8/1994 | Japan . |

*Primary Examiner*—Thomas N. Moulis
*Attorney, Agent, or Firm*—Lowe, Price, LeBlanc & Becker

[57] ABSTRACT

A determination is made as to whether or not a fuel tank for an engine or the like is being replenished with fuel. The temperature of the fuel in the fuel tank is detected, and if the fuel temperature is dropping a determination of fuel tank replenishment is arrived at. Desirably, it is determined that the fuel tank is being replenished, if fuel temperature dropping has occurred for a predetermined number of times over a predetermined time period. Further, by using such a detecting device in a breakdown diagnosis device for an evaporated fuel processing mechanism which diagnoses whether or not fuel leakage is taking place in a predetermined section of a flow path from the fuel tank to an intake passage of an automobile engine erroneous diagnosis is prevented by preventing diagnosis during fuel tank replenishment.

7 Claims, 4 Drawing Sheets

DEVICE FOR DETECTING REPLENISHMENT OF FUEL TANK OF AN ENGINE AND DIAGNOSTIC DEVICE FOR EVAPORATED FUEL PROCESSING MECHANISM OF THE ENGINE

FIELD OF THE INVENTION

This invention relates to a device which detects that a fuel tank for an automobile is being replenished with fuel, and further relates to a technique for preventing fuel tank replenishment from exerting a bad influence upon breakdown diagnosis for an evaporated fuel processing mechanism of an engine.

BACKGROUND OF THE INVENTION

In an evaporated fuel processing mechanism in which, in order for fuel which has been vaporized in a fuel tank of an automobile not to be released into the atmosphere and contaminate the environment, fuel evaporated in the tank is adsorbed into a canister, and the adsorbed fuel is supplied to the engine intake passage when the engine is running via a connecting conduit, if a leaking hole or a seal defect or the like should develop in the evaporated fuel connecting conduit or related structures, evaporated fuel will be released into the atmosphere, and the objective of the device will not be attained.

Due to this it is necessary to recognize breakdown of such a processing mechanism at an early stage, and, for example, the following type of breakdown diagnosis device may be utilized. To wit, in high temperature conditions or the like in which fuel evaporation is likely to occur, the evaporated fuel connecting conduit is closed off by a cutoff valve and the fuel evaporated in the fuel tank is supplied to the evaporated fuel connecting conduit which includes the canister, and the pressure in the evaporated fuel connecting conduit which leads from the fuel tank via the canister to the intake passage is detected by a pressure sensor. When the pressure of the evaporated fuel has risen above a predetermined level, the connection between the evaporated fuel connecting conduit and the fuel tank is cut off, and the subsequent dropping of the pressure in the isolated section after the point at which this conduit is thus cut off is observed. And leakage of the evaporated fuel is diagnosed based upon the characteristic according to which this pressure drops. This method of diagnosis is termed positive pressure diagnosis.

On the other hand so called negative pressure diagnosis is also performed in which, after the intake vacuum of the engine has been supplied to the space which comprises the evaporated fuel connecting conduit, the canister, and the fuel tank, and the pressure within this space has been lowered to a predetermined vacuum level, and after the connection between the intake passage of the engine and the evaporated fuel connecting conduit has been cut off by a cut off valve, the rise of the pressure within this space which has thus been isolated is observed.

Since a diagnosis device of this type performs diagnosis of leakage based upon the pressure which is detected by a pressure sensor, if during diagnosis the filler cap of the fuel replenishment aperture of the fuel tank is removed, for example in order to replenish the fuel, then atmospheric pressure is supplied into the evaporated fuel connecting conduit, and it becomes impossible to perform accurate leakage diagnosis.

Further, in the case that positive pressure diagnosis is to be performed, after the predetermined leakage diagnosis permission conditions have been satisfied before commencing the diagnosis, if the filler cap is removed during the time period while the initial processing stage is being performed in which the pressure within the diagnosis space into which the vapor pressure in the fuel tank is led is being brought to rise above the predetermined pressure level, then proper diagnosis cannot be performed since the vapor pressure is released.

Further, also for the case of negative pressure diagnosis, after the predetermined leakage diagnosis permission conditions have been satisfied, if the filler cap is removed during the time period of the initial processing until the pressure in the diagnosis space has been lowered down to the predetermined level by the supply of intake vacuum, the pressure within this space will undesirably be returned to atmospheric pressure. In this case as well, appropriate diagnosis cannot be performed.

If the key switch of the automobile is turned off when the fuel tank is being replenished then leakage diagnosis is not performed, and accordingly there is no danger of such erroneous diagnosis; but, in the event that replenishment of the fuel tank is performed with the key switch left on, if as described above the filler cap is removed during diagnosis or during the initial processing period, then there is a possibility of erroneous diagnosis. For this reason there have been proposed, for example in Tokkai Hei 2-130256 published by the Japanese Patent Office in 1990 and in Tokkai Hei 5-10215 published in 1993, devices which detect that fuel is being supplied into the fuel tank, based upon a signal from a filler cap open sensor, the signal from the fuel level gauge, or the like.

However, in the former case it is necessary additionally to provide a filler cap open sensor, which causes an increase in the cost of the diagnosis device. Also in the latter case it is necessary additionally to input the signal from the fuel level gauge into the control unit, and this also causes an increase in the cost of the diagnosis device. Further, the signal from the fuel level gauge is comparatively unstable due to sloshing of the surface of the liquid fuel within the fuel tank and the like, and it is difficult accurately and quickly to detect that the fuel tank is being replenished.

On the other hand it has been proposed in Tokkai Hei 6-81727 and Tokkai Hei 6-235354, both published by the Japanese Patent Office in 1994, to obtain a parameter which is required for leakage diagnosis by providing a fuel temperature sensor which detects the temperature of the fuel.

In these prior arts the temperature data obtained by the fuel temperature sensor are used for improving the accuracy of the leakage diagnosis and have nothing to do with the detection that fuel is being replenished.

SUMMARY OF THE INVENTION

It is therefore an object of this invention to construct at a low cost a device for detecting whether or not the fuel is being replenished by utilizing a fuel temperature sensor.

It is a further object of this invention to increase the accuracy of breakdown diagnosis of an evaporated fuel processing mechanism.

In order to achieve the above objects, this invention provides a device for detecting that fuel is being replenished into a fuel tank of an engine, comprising a mechanism for detecting temperature of the fuel in the fuel tank, and a mechanism for deciding, if the fuel temperature is dropping, that the fuel is being replenished.

It is preferable that the deciding mechanism decides that the fuel is being replenished if fuel temperature dropping has occurred for a predetermined number of times over a predetermined time period.

It is also preferable that the device further comprises a mechanism for preventing the deciding mechanism from deciding that the fuel is being replenished, when the atmospheric temperature is lower than a predetermined temperature value.

This invention also provides a breakdown diagnosis device for use with such an evaporated fuel processing mechanism that, after fuel which has evaporated in a fuel tank for an engine has been adsorbed by an adsorbing mechanism, supplies the adsorbed fuel by intake vacuum of the engine from the adsorbing mechanism via an evaporated fuel connecting conduit to an intake passage of the engine. The breakdown diagnosis device comprises a mechanism for detecting pressure in a predetermined section a flow path from the fuel tank up to the intake passage, a mechanism for closing off the predetermined section, a mechanism for deciding, based upon the change of the pressure in the predetermined section in a closed off state, whether or not leakage is taking place in the section, the aforesaid detecting device, and a mechanism for preventing the deciding mechanism from deciding whether or not leakage is taking place, when the fuel tank is being replenished with fuel.

It is also preferable that the breakdown diagnosis device further comprises a mechanism for deciding whether or not the engine is operating, and the prevention mechanism prevents the deciding mechanism from deciding whether or not leakage is taking place, when the engine is operating and also the fuel tank is being replenished with fuel.

It is also preferable that the breakdown diagnosis device further comprises a mechanism for setting the predetermined section to a predetermined pressure state which is required at the start of decision as to whether or not leakage is taking place, and a mechanism for resetting the setting by the setting mechanism if, while the setting mechanism is performing setting, the detecting device has detected that the fuel tank is being replenished with fuel.

The details as well as other features and advantages of this invention are set forth in the remainder of the specification and are shown in the accompanying drawings.

DESCRIPTION OF THE PREFERRED EMBODIMENTS

Figure 1:
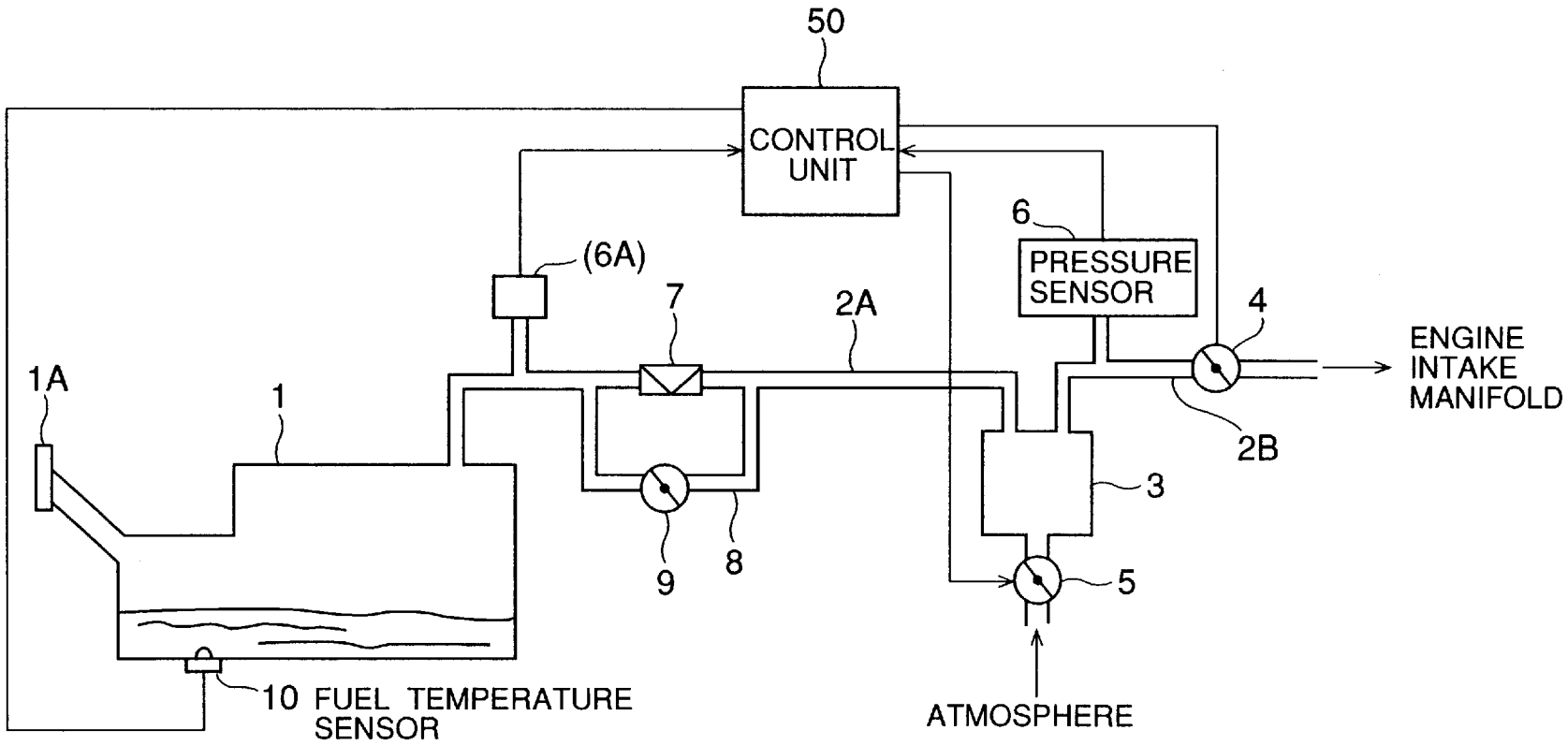
FIG. 1 is a schematic structural diagram of a breakdown diagnosis device for an evaporated fuel processing mechanism according to this invention.

Referring to FIG. 1 of the drawings, a fuel tank 1 for an engine of an automobile comprises a filler cap 1A which closes a fuel replenishment aperture, and one end of an evaporated fuel connecting conduit 2A is connected to the roof portion of this fuel tank 1. A check valve 7 is provided part way along the evaporated fuel connecting conduit 2A.

The other end of the evaporated fuel connecting conduit 2A is connected to a canister 3. This canister 3 comprises an adsorbing element which is made of activated charcoal, for adsorbing the evaporated fuel.

When the pressure in the fuel tank 1 rises above a predetermined pressure the check valve 7 is opened and fuel evaporated in the fuel tank 1 is fed into a canister 3; while, when the pressure in the fuel tank 1 is less than this predetermined value, the check valve 7 is closed so as to prevent reverse flow of the evaporated fuel back into the fuel tank 1.

A bypass connecting conduit 8 which bypasses the vacuum cutoff valve 7 is further provided to the evaporated fuel connecting conduit 2A, and a bypass valve 9 is provided in this bypass connecting conduit 8. To the canister 3 there are further connected another evaporated fuel connecting conduit 2B and a drain cutoff valve 5 for supplying atmospheric air into the canister 3.

The evaporated fuel connecting conduit 2B is connected to the intake manifold of the engine via a purge cutoff valve 4 and via a purge control valve not shown in the figure for controlling the purge flow amount. Although this purge cutoff valve 4 is an on/off valve which can only be either fully open or fully closed, it would also be possible, as an alternative, to provide this purge cutoff valve 4 with the function of controlling the amount of flow in order that the valve would also serve as the purge control valve.

A pressure sensor 6 is provided for detecting the pressure in the evaporated fuel connecting conduit 2B between the canister 3 and the purge cutoff valve 4. Further, a fuel temperature sensor 10 is provided in the bottom portion of the fuel tank 1 for detecting the temperature of the fuel therein.

The output signals from these sensors are input to a control unit 50. This control unit 50 comprises a CPU, ROM, RAM, A/D converter, input and output interfaces, and the like. The control unit 50 outputs control signals to the purge cutoff valve 4, the purge control valve, and the drain cutoff valve 5 based upon these input signals, and thereby performs control so as to open and close these valves and so as to control the flow amount of evaporated fuel.

The fuel which evaporates in the fuel tank 1 is adsorbed into the canister 3 via the evaporated fuel connecting conduit 2A. When the purge cutoff valve 4 is opened, the intake vacuum in the intake manifold is supplied to the evaporated fuel connecting conduit 2B, and when further the drain cutoff valve 5 is opened atmospheric air is supplied to the canister 3. By doing this, a flow of air is established from the drain cutoff valve 5 via the canister 3 and the evaporated fuel connecting conduit 2B into the intake manifold. And the evaporated fuel which has been adsorbed in the canister 3 is purged from the canister by this flow of air, and is sucked into the intake manifold along with the air.

The control unit 50 performs positive pressure diagnosis and negative pressure diagnosis in order to diagnose whether or not leakage of evaporated fuel is taking place from the connecting conduit from the fuel tank 1 to the purge cutoff valve 4. For the positive pressure diagnosis, the purge cutoff valve 4 and the drain cutoff valve 5 are closed while the bypass valve 9 is opened, and thereby the fuel evaporated in the fuel tank 1 is conducted into a positive pressure diagnosis section which is defined from the bypass valve 9 up to the purge cutoff valve 4. After this the bypass valve 9 is closed, and thereafter the dropping behavior of the pressure in the diagnosis section is observed and therefrom the presence or absence of leakage is decided upon.

For the negative pressure diagnosis, the drain cutoff valve 5 is closed while the purge cutoff valve 4 and the bypass valve 9 are opened, and thereby the negative pressure in the intake manifold is conducted to a diagnosis section which is defined from the fuel tank 1 up to the purge cutoff valve 4. After this the purge cutoff valve 4 is closed, and thereafter the rise behavior of the pressure in the diagnosis section is observed and therefrom the presence or absence of leakage is decided upon.

Figure 2:
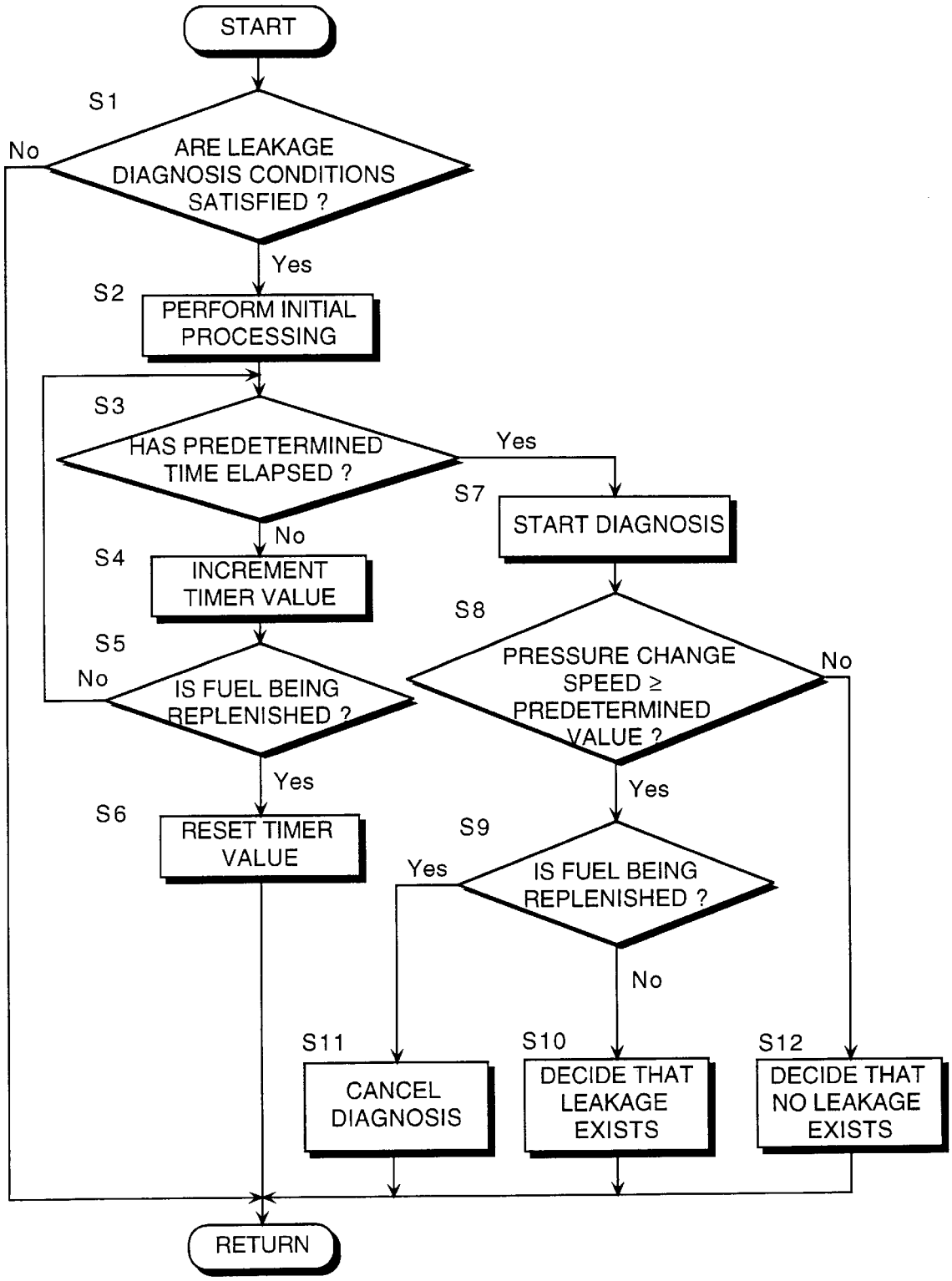
FIG. 2 is a flow chart for explanation of a leakage diagnosis process performed by this breakdown diagnosis device.

These diagnostic processes are performed according to the flow chart shown in FIG. 2. Since the principle of the diagnosis is common to both the positive pressure diagnosis and negative pressure diagnosis, this flow chart has been prepared without drawing any distinction between the two diagnosis. The processing details for each individual step may be, however, slightly different between the respective diagnosis, but which will be described in detail in the following explanation First, in a step S1, it is decided whether or not the leakage diagnosis conditions are satisfied. The conditions for positive pressure diagnosis are that evaporation of the fuel can easily occur and moreover that it is possible to perform leakage diagnosis with high accuracy. In more detail, they are: that purge processing is not being executed (the purge cutoff valve 4 is in the valve closed condition); that the engine is rotating; that the temperature of the engine, as represented by the coolant temperature or the like, is within a predetermined temperature range; that the engine rotational speed and/or the engine load are within predetermined ranges; that the temperature of the fuel and/or the atmospheric pressure are within predetermined ranges; that the vehicle road speed is within a predetermined range; that no breakdown has occurred in the sensor 6, the valves 4, 5, and 9, and so on; and the like.

The conditions for negative pressure diagnosis are that evaporation of the fuel is not occurring to any great extent, and that it is possible to perform leakage diagnosis with high accuracy without experiencing any influence from the vapor pressure of evaporated fuel. In more detail, they are: that purge processing is not being executed (the purge cutoff valve 4 is in the valve closed condition); that the engine is rotating; that the temperature of the engine, as represented by the coolant temperature or the like, is within a predetermined temperature range; that the engine rotational speed and/or the engine load are within predetermined ranges; that the temperature of the fuel and/or the atmospheric pressure are within predetermined ranges; that the vehicle road speed is within a predetermined range; that no breakdown has occurred in the sensor 6, the valves 4, 5, and 9, etc; that a predetermined time period has elapsed from when the engine was started; and the like. The abovementioned predetermined ranges are set differently for the case of positive pressure diagnosis and for the case of negative pressure diagnosis.

If these conditions for diagnosis hold the flow of control proceeds to a step S2, while if they do not hold then this control process terminates.

In the step S2, the initial processing for leakage diagnosis is performed. In the initial processing for positive pressure diagnosis, the purge cutoff valve 4 is maintained in the closed state, while the drain cutoff valve 5 is closed so as to isolate the previously described positive pressure diagnosis section from the atmosphere. Thereafter, the bypass valve 9 is opened. By doing this, fuel vapor which has evaporated in the fuel tank 1 is conducted into the positive pressure diagnosis section described previously. In the initial processing for negative pressure diagnosis, after the drain cutoff valve 5 has been closed, the purge cutoff valve 4 and the bypass valve 9 are opened, and intake manifold vacuum is conducted to the negative pressure diagnosis section described previously.

In a step S3, a decision is made as to whether or not a predetermined time period has elapsed from the start of the initial processing in the step S2. In the case of positive pressure diagnosis, due to the evaporation of the fuel, the pressure in the positive pressure diagnosis section must have risen up to a predetermined pressure during the elapsing of this predetermined tine period, and in this case in a step S7 the bypass valve 9 is closed and diagnosis of leakage from the positive pressure diagnosis section is commenced. In the case of negative pressure diagnosis, due to the supply of engine manifold vacuum, the pressure in the negative pressure diagnosis section must have dropped down to a predetermined vacuum value during the elapsing of this predetermined time period, and in this case in the step S7 the purge cutoff valve is closed and diagnosis of leakage from the negative pressure diagnosis section is commenced. When in the decision of the step S3 it has been decided that the predetermined time period has not yet elapsed the flow of control proceeds to a step S4 and a timer is incremented (increased by unity), and the flow of control proceeds to a step S5.

Figure 3:
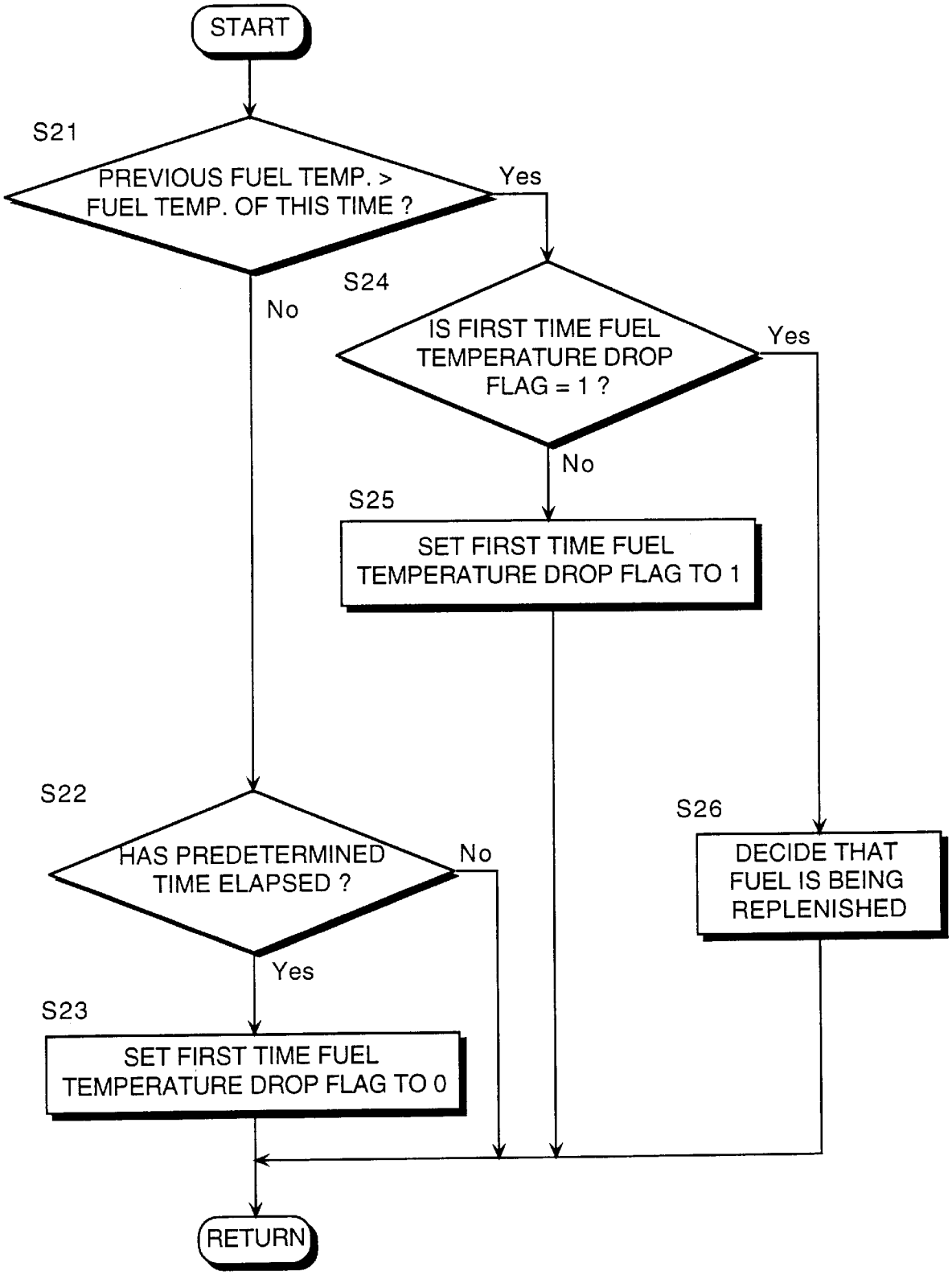
FIG. 3 is a flow chart for explanation of a subroutine, for this breakdown diagnosis device, for deciding whether or not the fuel is being replenished.

In the step S5, by the previously mentioned subroutine whose flow chart is shown in FIG. 3, a decision is made as to whether or not fuel is being replenished into the fuel tank 1.

If the fuel tank is thus being replenished, in a step S6 the timer is reset to 0 and the breakdown diagnosis procedure of FIG. 2 terminates. If the fuel tank is not being replenished, the processing in the steps S3 through S5 is repeated until a predetermined time period has elapsed.

Figure 4:
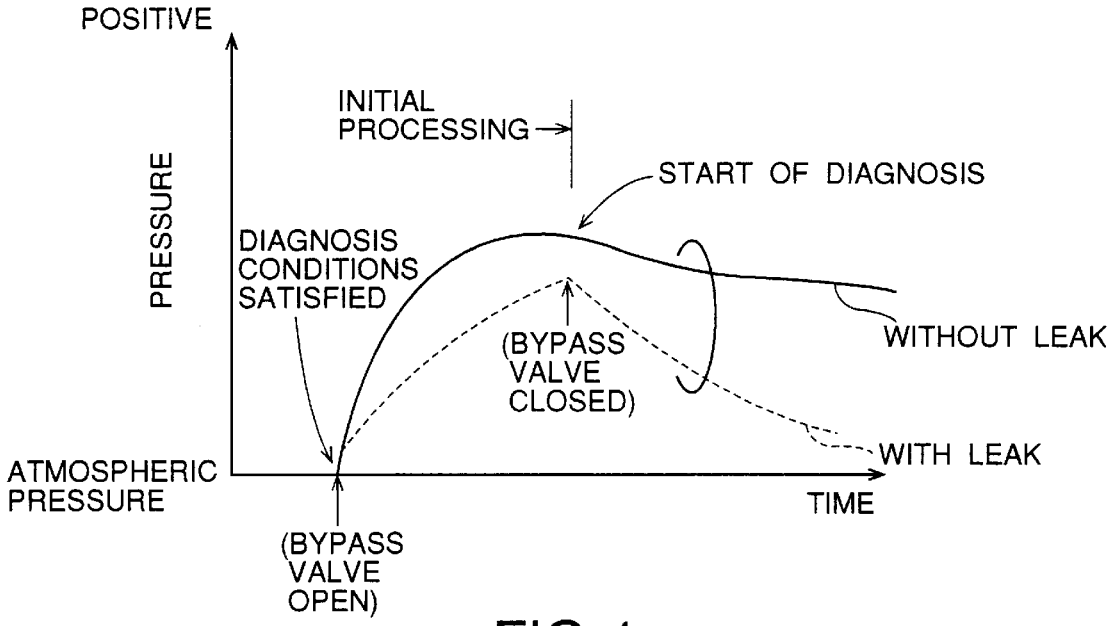
FIG. 4 is a timing chart for explanation of the details of positive pressure diagnosis by this breakdown diagnosis device.
Figure 5:
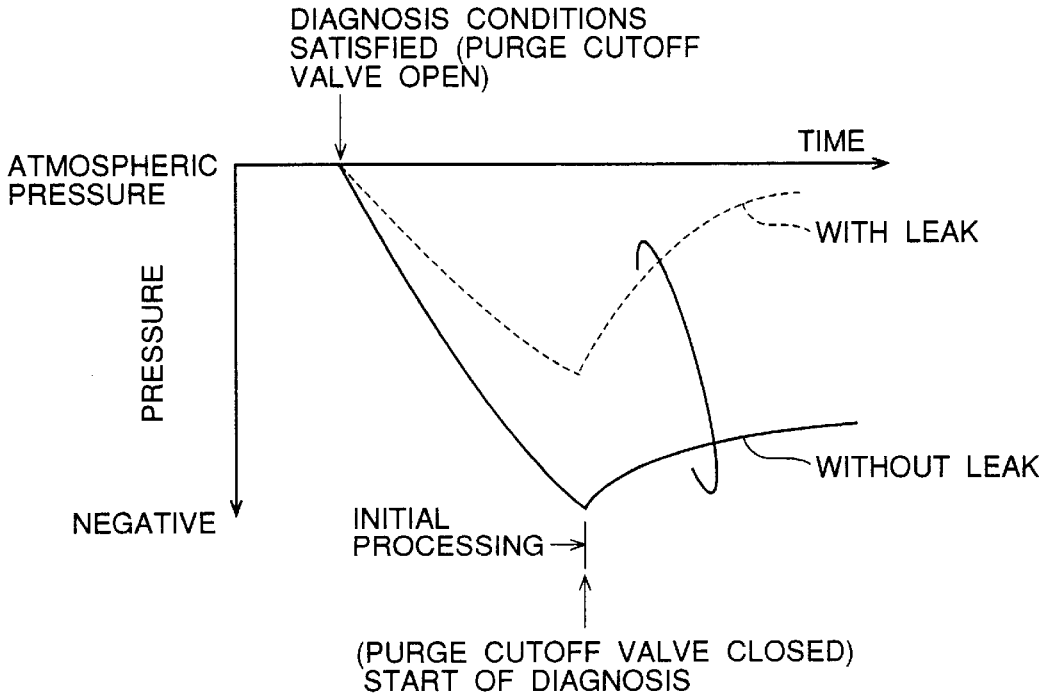
FIG. 5 is a timing chart for explanation of the details of negative pressure diagnosis by this breakdown diagnosis device.

On the other hand, after the diagnosis of leakage has been started in the step S7, the signal from the pressure sensor 6 is monitored in a step S8. And, in the case of positive pressure diagnosis, as shown in FIG. 4, the speed with which the pressure in the positive pressure diagnosis section drops downwards towards atmospheric pressure is measured, and the presence or absence of leakage is decided upon based upon comparison of this speed with a predetermined value. In the case of negative pressure diagnosis, as shown in FIG. 5, the speed with which the pressure in the negative pressure diagnosis section rises upwards towards atmospheric pressure is measured, and the presence or absence of leakage is decided upon based upon comparison of this speed with a predetermined value.

If the rate of change of the pressure is smaller than the predetermined value then the change of pressure is considered to be sluggish, and in a step S12 a diagnosis of no leakage such as would be caused by breakdown is arrived at, and this routine terminates.

In the case of both positive pressure diagnosis and negative pressure diagnosis, if the rate of change of the pressure is greater than the predetermined value, this means that the pressure in the diagnosis section quickly returns to near atmospheric pressure. The cause of this must be either that leakage is occurring from the diagnosis section, or that replenishment of fuel into the fuel tank has been performed during the diagnosis process.

Thus, in order to distinguish between these two cases, in a step S9 a decision is made as to whether or not fuel is being replenished into the fuel tank. This decision is made using the subroutine shown in FIG. 3.

If it has been decided in the step S9 that fuel is being supplied, then in a step S11 the diagnosis of presence or absence of leakage is canceled, and this routine terminates. Further, in the case that it has been decided that fuel is not being supplied, then in a step S10 it is decided that a leakage which must be considered as a breakdown is occurring, and this routine terminates after informing the driver of the vehicle that an abnormality has occurred by illuminating a warning lamp or the like.

In this connection, if positive pressure diagnosis is being performed, then, since the positive pressure diagnosis region is isolated from the fuel tank 1 at the time point when the bypass valve 9 is closed off, even if at this stage fuel is replenished, this has no influence upon the positive pressure diagnosis. Due to this, it is possible to omit the steps S9 and S11 from the routine for positive pressure diagnosis. However, if the filler cap 1A is opened while the bypass valve 9 is opened so as to conduct positive pressure (the fuel vapor pressure) into the diagnosis section, then the pressure in the diagnosis section will not rise, and an error in positive pressure diagnosis will ensue. Accordingly, in order properly to execute the positive pressure diagnosis, it is not possible to omit the step S5.

Further, although in this embodiment the section from the fuel tank 1 up to the check valve 7 is excluded from the positive pressure diagnosis section, it is possible to include this section as well in the positive pressure decision section, by providing a pressure sensor 6A in the vicinity of the fuel tank 1 as shown in FIG. 1. In this case, the steps S9 and S11 become necessary for the positive pressure diagnosis routine as well.

Next, the subroutine which decides whether or not replenishment of the fuel tank 1 is taking place will be explained using the flow chart of FIG. 3.

In a step S21, a decision is made as to whether or not the temperature measured the previous time by the fuel temperature sensor 10 is higher than the temperature measured this time. In order to do this, the control unit 50 is set so as to store in a memory the fuel temperature signal which is input from the fuel temperature sensor 10.

If the fuel temperature measured the previous time is not higher than the fuel temperature measured this time, then in a step S22 a decision is taken as to whether or not a predetermined time period has elapsed since a first time fuel temperature drop flag was set. This first time fuel temperature drop flag can assume the value zero or unity and is set in a step 23 which follows the step S22. So, at the first execution of this subroutine in the course of the breakdown diagnosis, the decision in the step S22, is always affirmative because the diagnosis process is executed generally only once in a trip of the automobile, i.e., the elapsed time between the breakdown diagnosis is large. If the predetermined time period has elapsed from the time point at which the flag was set the time before, in a step S23 the first time fuel temperature drop flag is set to zero. If on the other hand the predetermined time period has not elapsed, then the first time fuel temperature drop flag is left as it is and this subroutine terminates.

On the other hand, if the fuel temperature which was measured the time before is higher than the fuel temperature which has been measured this time, then the flow of control proceeds to a step S24, and a decision is made as to whether or not the first time fuel temperature drop flag is equal to unity.

If the first time fuel temperature drop flag is not equal to unity, then in a step S25 the value of this first time fuel temperature drop flag is set to unity and this subroutine terminates. On the other hand, if the first time fuel temperature drop flag is equal to unity, then, since the conditions of the step S21 have been satisfied twice during the predetermined time period, it is clear that the fuel temperature can reliably be considered to be dropping.

In this case, it is determined in a step S26 that fuel is being replenished into the fuel tank 1, and a YES decision result is returned for the step S5 or the step S9. In all other cases, for example even in the case that in the step S25 the first time fuel temperature drop flag has been set to unity, a NO decision result is returned for the step S5 or the step S9. Accordingly, the decision in the step S9 that the fuel tank 1 is being replenished is limited to the case that the first time fuel temperature drop flag has been set to unity before the starting of leakage diagnosis in the step S7.

In the case of an engine which is provided with a fuel injection valve, the construction is such that during normal operation an amount of fuel which is normally sufficient is supplied from the fuel pump, and after the fuel injection valve has injected a suitable amount of fuel into its cylinder the remainder of the fuel is recirculated back to the fuel tank 1. The temperature of this recirculated fuel is comparatively high because it has been compressed by the pump, and as a result the temperature of the fuel in the fuel tank 1 is elevated.

Thus, if the fuel temperature which is detected by the fuel temperature sensor 10 has dropped, it is determined that new fuel of a comparatively low temperature is being replenished into the fuel tank 1 from the outside.

However, if the outside temperature is extremely low, there is a possibility that the temperature of the fuel in the fuel tank 1 may drop even if the fuel tank 1 is not being replenished. Accordingly, in this type of case, if it is determined whether or not the fuel tank is being replenished only upon the basis of the fuel temperature, there is a possibility that the determination may be erroneous. For this reason, in extremely cold conditions when the external temperature is lower than a predetermined value, it is desirable to prevent the diagnosis of leakage, which might erroneously show, for example, that fuel was always being replenished into the fuel tank.

The embodiments of this invention in which an exclusive property or privilege is claimed are defined as follows:

1. A device for detecting that fuel is being replenished into a fuel tank of an engine, comprising:

means for detecting temperature of the fuel in the fuel tank, and means for deciding, if the fuel temperature is dropping, that the fuel is being replenished.

2. A device according to claim 1, wherein said deciding means decides that the fuel is being replenished if fuel temperature dropping has occurred for a predetermined number of times over a predetermined time period.

3. A device according to claim 1, further comprising means for preventing said deciding means from deciding that the fuel is being replenished, when the atmospheric temperature is lower than a predetermined temperature value.

4. A diagnostic device for use with an evaporated fuel processing mechanism which, after fuel, which has evaporated in a fuel tank for an engine, has been adsorbed by an adsorbing means, supplies said adsorbed fuel by intake vacuum of said engine from said adsorbing means via an evaporated fuel connecting conduit to an intake passage of said engine, said diagnostic device comprising:

means for detecting a pressure in a predetermined section of a flow path leading from said fuel tank to said intake passage, means for closing off said predetermined section, means for deciding, based upon the change of the pressure in said predetermined section in a closed off state, whether or not leakage is taking place in said section, a device for detecting that fuel is being replenished into the fuel tank, said detecting device comprising means for detecting a temperature of the fuel in the fuel tank, and means for deciding, if the fuel temperature is dropping, that the fuel is being replenished, and means for preventing said deciding means from deciding whether or not leakage is taking place, when said fuel tank is being replenished with fuel.

5. A diagnostic device according to claim 4, further comprising means for deciding whether or not said engine is operating, and wherein said prevention means prevents said deciding means from deciding whether or not leakage is taking place, when either said engine is operating and said fuel tank is being replenished with fuel.

6. A diagnostic device according to claim 4, further comprising:

means for setting said predetermined section to a predetermined pressure state which is required at the start of decision as to whether or not leakage is taking place, and means for resetting the setting by said setting means if, while said setting means is performing setting, said detecting device detects that said fuel tank is being replenished with fuel.

7. A diagnostic device for detecting that fuel is being replenished into a fuel tank of an engine, comprising:

a sensor for detecting temperature of fuel in the fuel tank, and a microprocessor responsive to said sensor and programmed for deciding in response to a drop in fuel temperature, that the fuel is being replenished.

* * * * *